US008284981B2

(12) United States Patent
Cataldo et al.

(10) Patent No.: US 8,284,981 B2
(45) Date of Patent: Oct. 9, 2012

(54) CARTRIDGE FOR MANAGING EAR BUDS

(75) Inventors: John Cataldo, Westlake Village, CA (US); Daniel C. Sullivan, Santa Barbara, CA (US); Mardis Bagley, San Francisco, CA (US)

(73) Assignee: Head Logic, LLC, Westlake Village, CA (US)

( * ) Notice: Subject to any disclaimer, the term of this patent is extended or adjusted under 35 U.S.C. 154(b) by 0 days.

(21) Appl. No.: 13/348,108

(22) Filed: Jan. 11, 2012

(65) Prior Publication Data

US 2012/0224738 A1 Sep. 6, 2012

Related U.S. Application Data

(63) Continuation of application No. 13/153,403, filed on Jun. 4, 2011.

(60) Provisional application No. 61/447,816, filed on Mar. 1, 2011.

(51) Int. Cl.
*H04R 25/00* (2006.01)

(52) U.S. Cl. ..... 381/384

(58) Field of Classification Search ..... 381/384, 381/374, 370, 376, 309; 455/575.2, 569.1; 379/431

See application file for complete search history.

(56) References Cited

U.S. PATENT DOCUMENTS

| | | | | |
|---|---|---|---|---|
| 5,724,667 | A * | 3/1998 | Furuno | 455/575.2 |
| 6,011,686 | A | 1/2000 | Grasso et al. | |
| 6,179,238 | B1 | 1/2001 | Phillipps | |
| 6,633,770 | B1 | 10/2003 | Gitzinger | |
| 6,825,810 | B2 | 11/2004 | Ranger | |
| 7,077,693 | B1 | 7/2006 | Symons | |
| D566,107 | S | 4/2008 | Bowling | |
| 7,599,509 | B2 * | 10/2009 | Ito | 381/384 |

OTHER PUBLICATIONS http://www.stylishnomad.com/travel-accessories/mp3-and-mobile-accessories/push-button-retractable-earphones-bees.html?gclid=CN7o1PXU868CFasBQAodSBA9Xg, May 9, 2012.

* cited by examiner

*Primary Examiner* — Davetta W Goins
*Assistant Examiner* — Phylesha Dabney
(74) *Attorney, Agent, or Firm* — Kevin H. Fortin, Esq.

(57) ABSTRACT

A cartridge for managing ear bud cables includes a housing, a hub, a spool with a moveable audio contact and an ear bud cable. The housing has an input jack that is electronically connectable to an audio-source. The hub defines a stationary contact surface electrically connected with the input jack. The ear bud cable wraps at least partially around the spool, the ear bud cable has a first end and a second end, the first end being electrically connected with the moveable audio contact of the spool and the second end being electrically connected with at least one ear bud. Rotation of the spool selectively retracts and dispenses the ear bud cables while enabling continuous audio communication between the at least one ear bud and the audio source.

16 Claims, 5 Drawing Sheets

CARTRIDGE FOR MANAGING EAR BUDS

PRIORITY CLAIM

This invention claims priority to U.S. Provisional Patent Application Ser. No. 61/447,816, which was filed 1 Mar. 2011, the disclosure of which is incorporated herein by reference.

FIELD OF THE INVENTION

The present invention relates to ear bud cables and particularly to devices for dispensing and retracting ear bud cables.

BACKGROUND OF THE INVENTION

Ongoing research indicates a relationship between prolonged exposure to cell phone radiation and illness. The risk of illness decreases significantly where cell phones are used at a distance from the user. Positioning a cell phone even a few inches away the ear can greatly reduce harm from cell phone radiation.

There are several ways to manage the health risks associated with prolonged cell phone use. One way is to use a speakerphone and hold the phone at a distance. However, many do not want their phone conversations overheard, or to disturb others with a loud two way conversation. Additionally, prolonged use of the speakerphone can greatly reduce battery life.

Another way to reduce health risks associated with cell phone use is to use a Bluetooth headset. The energy radiated by a phone with a typical Bluetooth headset is orders of magnitude less than a cellular phone signal, which typically is communicated between the cell phone and a distant cell phone tower. One drawback of a Bluetooth headset is that there is often a reduction in sound quality when compared to the sound quality of wired connections. Audiophiles also demand stereo sound, which is unavailable with single-ear bud Bluetooth headset models.

Yet another way to reduce health risks is to use a wired headset. Wired ear buds may, for example, insert into a user's ear, hang on the ear, or hang on the head. Ear buds are energy efficient and have lessened health risks due to radiation. When two ear buds are used, stereo sound is possible.

One major drawback of using wired ear buds with portable consumer electronics devices and telephones is cord management. Cord management is a commonly experienced problem where the cord of the ear buds becomes tangled and may be damaged by a frustrated user who attempts to hastily untangle the cord. Operating an automobile, a bicycle, or other vehicle while experiencing cord management problems can be dangerous. What is desired is a better way of cord management which enables the user to readily extend and retract ear bud cables in a rapid and reliable manner.

SUMMARY OF THE INVENTION

The present invention includes a cartridge for managing ear bud cables. The cartridge includes a housing having an input jack, a hub, a rotatable spool and an ear bud cable that is selectively wrapped around the spool. The term ear bud as used herein includes any audio speakers that mount on the head of a user, either outside the ear or within the ear of a user.

The input jack is electronically connectable to an audio-source. The hub is fixed having a stationary contact surface. The audio contacts are electrically connected with the input jack.

The spool is rotatably mounted with respect to the hub. In one embodiment, the spool circumscribes the hub. In an alternate embodiment the hub defines a hollow interior and a portion of the spool inserts into the hub. The spool includes moveable audio contacts for continuously contacting the stationary contact surface during rotation of the spool.

An ear bud cable wraps at least partially around the spool during use. The ear bud cable has a first end and a second end. The first end is electrically connected with the moveable audio contact of the spool and the second end is electrically connected with at least one ear bud.

Rotation of the spool selectively retracts and dispenses the ear bud cables while maintaining audio communication between the at least one ear bud and the audio source.

Various details of an embodiment of the invention include providing a stationary contact surface with at least one conductive contact circumscribing the hub. In an alternate embodiment, the conductive contact surface includes several metallic contacts circumscribing the hub. The hub includes circumferential ridges which separate the several metallic contacts.

The housing has an output jack integrated with the input jack and the ear bud cables include a microphone for communicating voice via the cartridge. In this way, the ear bud cables are useable with mobile telephones.

The ear bud cable is flat, having a height and a width, wherein the width is more than twice the height. The flat cable configuration reduces any risk that the cable will bind in the cartridge. The flat cable configuration ideally consumes less space than round cable shapes. Preferably, the ear bud cable includes two ear buds and a microphone.

The spool has an upper gear and a lower gear. The upper gear and the lower gear define a cable track between the upper gear and the lower gear for receiving the ear bud cable. The cartridge includes a power gear mounted in the housing and being connectable in operable engagement with both the upper gear and the lower gear of the spool. The cartridge also includes power spring mounted in the housing in contact with the power gear to rotate the power gear and the spool.

The power spring has a spiral shape designed to maintain a relatively consistent torque on the power gear and the spool. The invention also includes a rotary damper attached within the housing and connected in operable engagement with spool to regulate rotational velocity of the spool.

In one embodiment, the rotary damper gear and the power gear have gear teeth connected in operable engagement with the upper gear and the lower gear of the spool to regulate rotational velocity of the spool. In an alternate embodiment, the spool, the power gear and the rotary damper gear are without gear teeth, and rely solely on friction to operate. In each case the rotary damper and power gear press against the spool with tangential pressure to maintain alignment of the spool, and with radial pressure at certain times such as when the spool may become misaligned. Accordingly, the rotary damper gear and the power gear function to regulate rotation of the spool and to maintain spool alignment, which improves reliability and durability of the cartridge.

DETAILED DESCRIPTION

Figure 1:
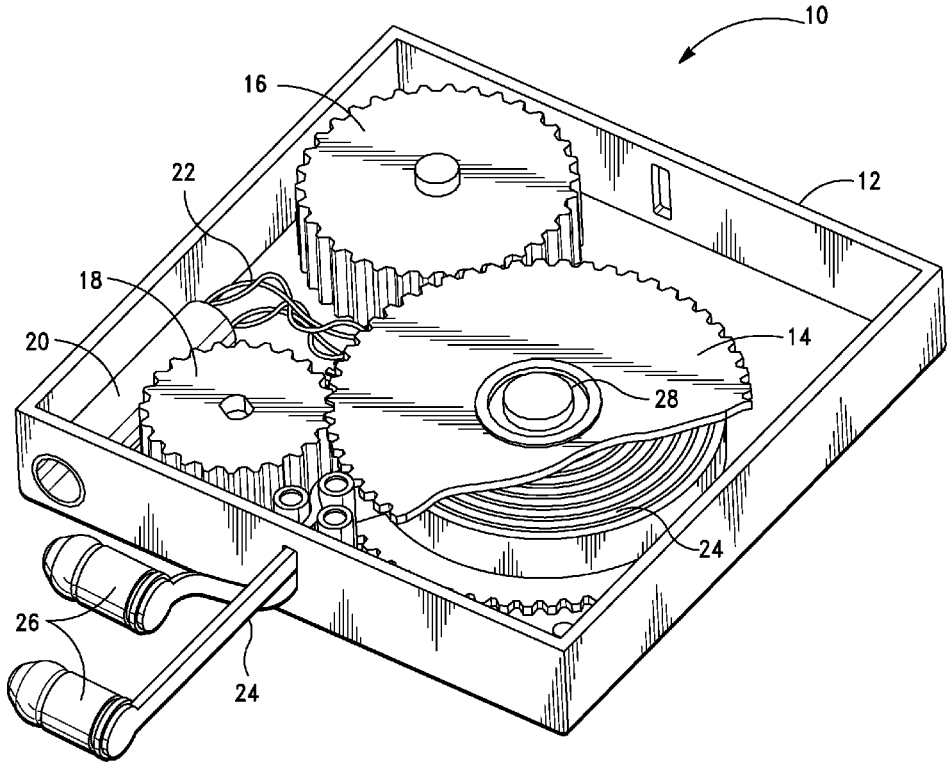
FIG. 1 shows a perspective view of a cord management cartridge in accordance with the present invention.

FIG. 1 is a cartridge generally designated by the reference numeral 10. The cartridge 10 includes housing 12, a spool 14, a power gear 16, a rotary damper gear 18, an input jack 20, an electrical connector 22, an ear bud cable 24, ear buds 26 and a hub 28.

The hub 28 is fixed within the housing 12. The spool 14 rotatably mounts on the hub 28. Rotation of the spool 14 dispenses and retracts the ear bud cable 24 from the housing 12.

The rotary damper gear 18 is rotatably mounted within the housing 12. The rotary damper gear 18 mates in operative engagement with the spool 14 so that the rotary damper gear 18 presses against the spool 14. In particular, both the rotary damper gear 18 and the spool 14 each have a periphery. The periphery of the rotary damper gear 18 and the periphery of the spool 14 press against each other in a direction tangential to the respective peripheries, and may press against each other in a radial fashion. The rotary damper gear 18 and the spool 14 mate so that free rotation of the spool 14 is inhibited by the rotary damper gear 18.

In this way, the rotary damper gear 18 limits the maximum angular velocity of the spool 14. Limiting the angular velocity of the spool 14 protects the cartridge 10 from damage. Limiting the angular velocity of the spool 14, in cooperation with the rotary damper gear 18 pressing against the spool 14 inhibits misalignment of the spool 14 to maximize durability of the cartridge 10. Preferably the rotary damper gear 18 and the spool 14 include peripheral gear teeth which mate to further improve alignment to optimize movement of the moving components, and improve cartridge 10 reliability.

When gear teeth are used, improved tangential pressure is achieved between the spool 14, the rotary damper gear 18 and the power gear 16. An element of radial force is also applied between these elements when one of the elements misaligns. Thus the function of the gears includes maintaining alignment of the spool 14. Improved alignment of the spool increases the reliability of the cartridge 10.

Although the use of the power gear 16 in a rotary damper gear are disclosed here in it can be appreciated that many ways of providing power to the spool 14 can be devised. Furthermore many ways of regulating the angular velocity of the spool 14 can also be provided. For example at dampening mechanism may include a leaf spring mounted within the housing which presses on the peripheral surface of the spool 14 can create sufficient frictional force to dampen rotation of the spool 14.

Additionally a power mechanism such as a spiral power spring can be mounted on the housing with respect to the spool 14 so that the spring directly contacts the spool 14 and thereby powers the spool.

Furthermore, linkages such as a chain, a belt, or other mechanical transmission mechanism can be used to regulate rotation of the spool.

The ear bud cable 24 wraps at least partially around the spool 14. The ear bud cable 24 as a first end attached within the spool and a second and attached to ear buds 26. The ear bud cable 24 is flat to optimize alignment of the cable 24 within the spool 14 when the cable is retracted and dispensed. Utilizing a flat cable 24 minimizes the thickness of the cable to maximize the length of the cable that can be wrapped around the spool 14. The flat cable 24 minimizes entanglement of the cable 24, as compared to the use of a round cable.

The cartridge 10 utilizes the power gear 16 to selectively rotate the spool 14, or to assist in spool 14 rotation. The power gear can be externally actuated by a switch operated by a user, or by pulling the cable 24 in the way traditional window shade works. In particular, a quick pull of the cable 24 causes the power gear and the spool 14 to retract the cable 24, and a slower pull of the cable 24 enables the power gear and the spool to dispense the cable 24. The power gear 16 can be calibrated to assist in response a desired pressure applied on the cable 24.

Rotation of the power gear 16 in one direction retracts the cable 24. Counter rotation of the power gear 16 dispenses the cable 24. The power gear 16 has a periphery which presses against the periphery of the spool. Preferably the power gear 16 has peripheral gear teeth which mate with the peripheral gear teeth of the spool 14 to improve alignment and reliability of the cassette 10. The power gear 16 is spring biased to apply consistent torque to the spool 14. Applying consistent torque to the spool 14 helps to maintain a relatively constant angular velocity of the spool 14. The cooperation of the power gear 16 and the rotary dampening gear 18 assure that a constant angular velocity of the spool 14 will be achieved to cartridge 10 reliability.

Figure 2:
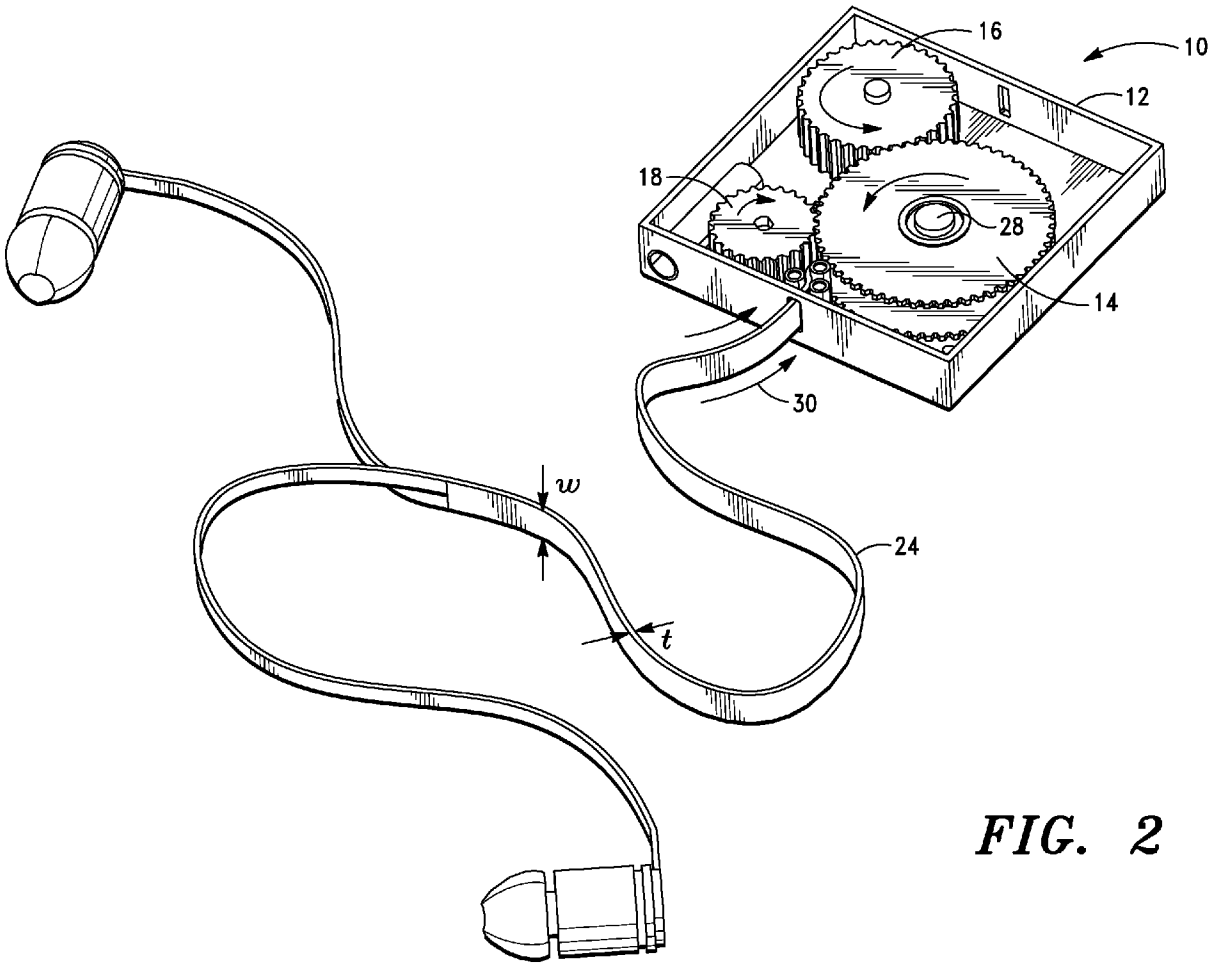
FIG. 2 shows a perspective view of the cord management cartridge retracting an ear bud cable.

FIG. 2 shows rotation of the power gear 16 causing counter rotation of the spool 14, which retracts ear bud cable 24 in the direction of the arrow 30. The rotary damper gear 18 rotates in response to rotation of the spool 14 to regulate the angular velocity of the spool 14 as well as the rate of retraction of the ear bud cable 24. Regulation of the rate of retraction of the ear bud cable 24 increases reliability of the cartridge 10 by inhibiting misalignment of the cable 24 within the spool 14.

Although the rotary damper gear 18 and the power gear 16 are shown as separate elements, it can be appreciated that the function of these two elements can be combined into a single element to minimize size and weight of the cartridge 10.

The cable 24 has a width "w" and a thickness "t". The cable 24 is flat and the thickness "t" is thinner than half of the width "w". Preferably, the thickness "t" is minimized to enable cartridge 10 to maximize the amount of cable 24 that can be managed by the cartridge 10.

The cable 24 preferably includes a microphone for use with telephonic applications. The microphone enables the input jack to simultaneously function as an output jack.

Figure 3:
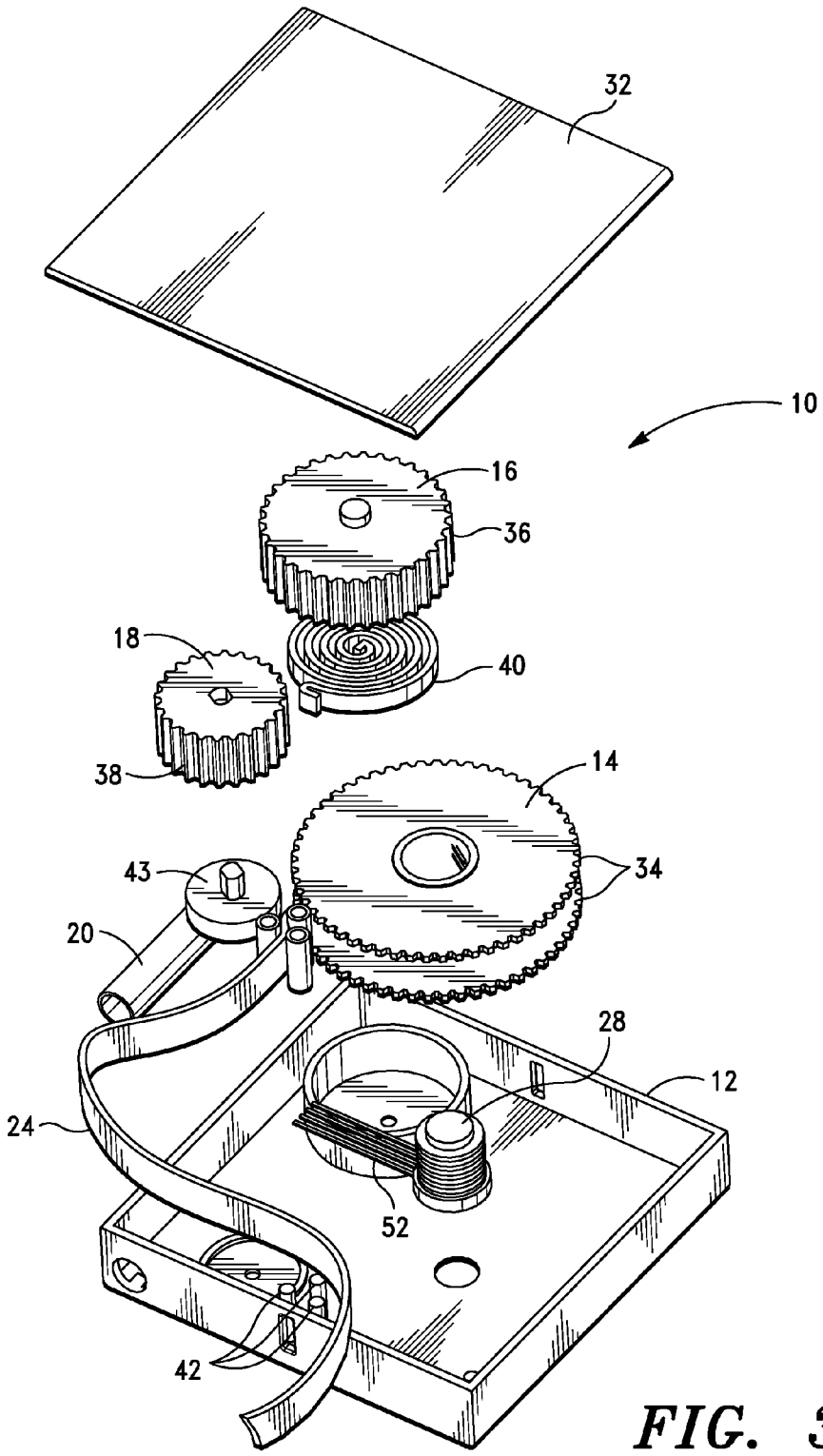
FIG. 3 shows an exploded perspective view of a cord management cartridge.

FIG. 3 shows the cartridge 10 including the housing 12 and a cover 32, which encloses the housing 12. The housing includes a hub 28 six within the housing 12 the hub 28 is sized to receive the spool 14 in operative engagement. The hub 28 includes electrical connectors 52, which communicate electronically with the input jack 20.

The power gear 16 defines peripheral gear teeth 36 and includes a power gear spring 42 to actuate the power gear 16. The power gear spring 40 attaches to the housing 12 and to the power gear 16 to selectively apply torque to the power gear 16. Ideally, the torque would be uniform in magnitude.

When the power gear spring 40 applies torque to the power gear 16 the power gear 16 rotates the spool 14 to selectively retract or dispense the cable 24. When the spool 14 rotates the rotary damper gear 18 regulates the angular velocity of the spool 14 the rotary damper gear 18 includes gear teeth 38 defined on the periphery of the rotary damper gear teeth 38 meet with peripheral gear teeth 34 of the spool 14. In particular, the spool 14 has two sets of peripheral gear teeth 34 that parallel each other and simultaneously meet with the gear teeth 38 of the rotary damper gear.

The cartridge 10 also includes a rotary damper 43 attached between the housing 12 and the rotary damper gear 18. The rotary damper 43 is fixed within the housing 12 and includes a rotatable axle for receiving the rotary damper gear 18. The axle enables rotation of the rotary damper gear 18 on the axle. The rotary damper 43 regulates angular velocity the rotary damper gear 18 thus regulating angular velocity of the spool 14.

Figure 4:
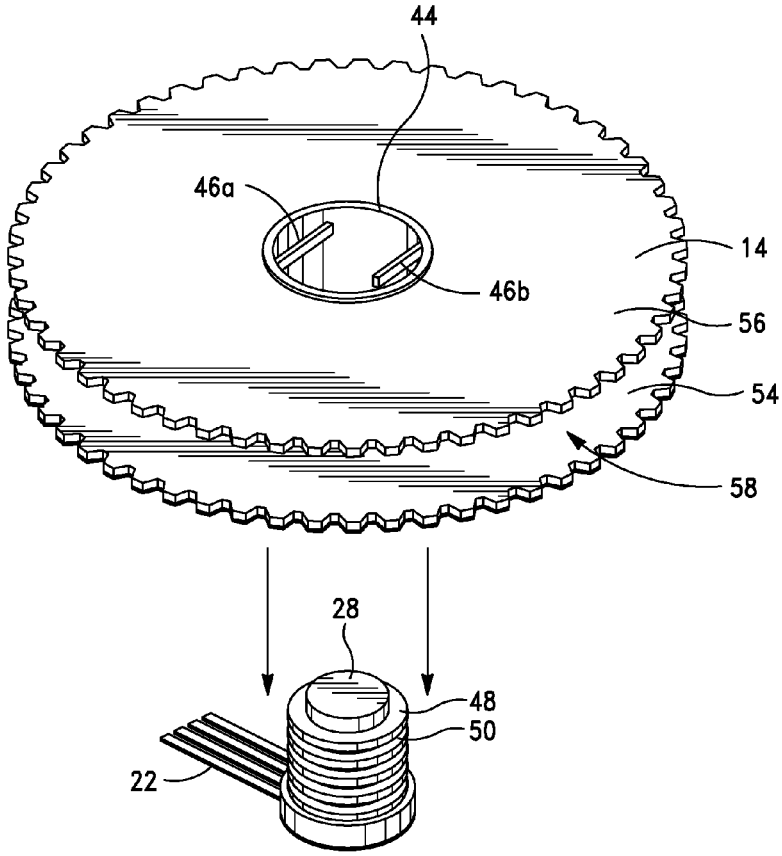
FIG. 4 shows an exploded perspective view of a hub and spool in accordance with the present invention.

FIG. 4 shows the hub 28 and the spool 14. The spool 14 includes an inner periphery 44 defining an opening. The opening is defined axially on the spool 14. The spool 14 includes moveable audio contacts 46(*a*) and 46(*b*). The movable audio contacts 46(*a*) and 46(*b*) extend radially inwards from the inner periphery 44 to enable the movable audio contacts 46(*a*) and 46(*b*) to establish a continuous electrical connection with the hub 28.

The moveable audio contacts 46(*a*) and 46(*b*) as shown are resilient conductive contacts, and may, or may not be pin shaped. Further it should be understood that moveable audio contacts 46 (*a*) and 46(*b*) may include brushes, and other commonly used contacts. The moveable audio contacts 46(*a*) and 46(*b*) may be metallic, but could also be formed from any suitable electrically conductive material. Preferably, the moveable audio contacts 46 include moveable audio pins.

The hub 28 is fixed within the housing and oriented to enable rotation of the spool 14. The hub 28 includes several electrical contacts 50. The electrical contacts 50 are ring shaped defining continuous annular rings which circumscribe the hub 28. The electrical contacts 50 are separated by several ring shaped circumferential ridges 48, which says circumscribe the hub 28 between each electrical contact 50. The ridges 48 assure that the electrical contacts 50 remain fixed with respect to the hub 28 when the 14 rotates on the hub 28. The ridges 48 further assure alignment of the spool 14 during operation. This improves the reliability of the cartridge 10.

The hub 28 further includes electrical connectors 22 which extend hard-wired from each electrical contact 22 to the input jack 20 of FIG. 1.

Figure 5:
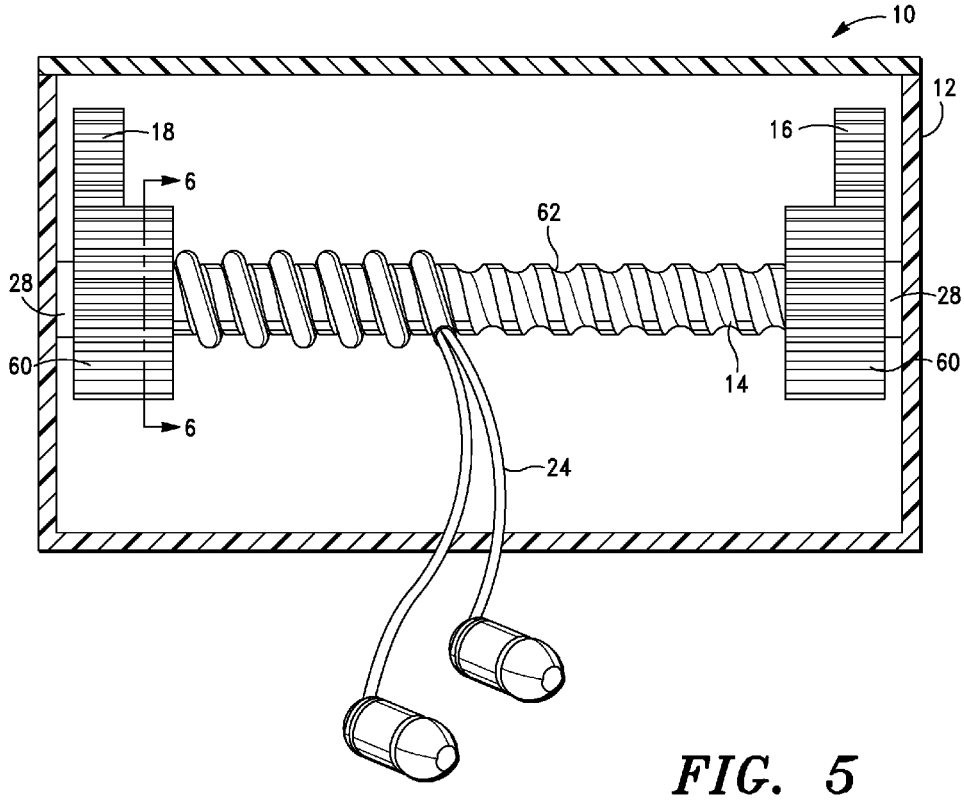
FIG. 5 shows a top view of an alternate embodiment of the cord management cartridge in accordance with the present invention.

FIG. 5 shows an embodiment of cartridge 10 having a spool 14 mounted transversely across the housing 12. The housing 12 includes two hubs 28 and the spool 14 has two ends. Each end of the spool 14 rotatably mounts with respect to a hub 28.

Preferably, the hubs 28 are stationary and define a central opening. The ends of the spool insert within each hub 28 opening, respectively. In an alternate embodiment, the ends of the spool surround the hubs 28 and the hubs 28 insert into the ends of the spool.

Each end 60 of the spool 14 further includes gear teeth 62 to enable a power gear 16 and a rotary damper gear 18 to engage the spool 14.

The spool 60 is a spindle shape having a helical groove 62 for receiving the ear bud cables 24. A helical groove 62 is configured to optimally align and inhibit entanglement of the ear bud cables 24. The power gear 16 and the rotary damper gear 18 each engage a single end of the spool 14.

Figure 6:
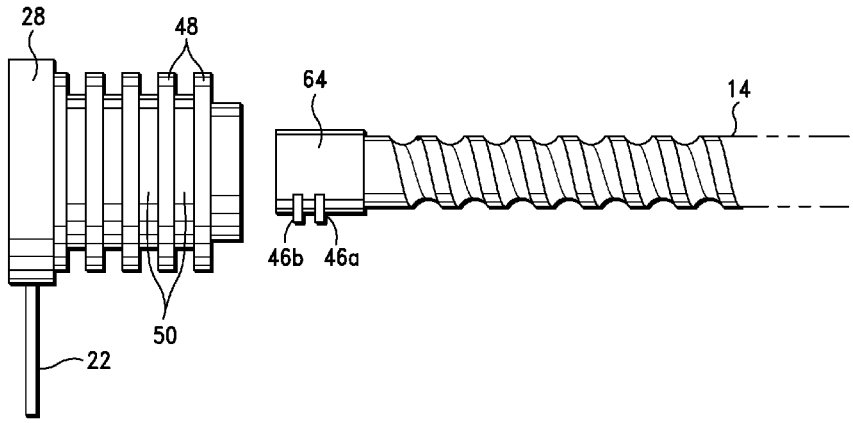
FIG. 6 shows a side view of a hub and spool in accordance with the embodiment shown in FIG. 5.

FIG. 6 shows an embodiment of the hub 28 receiving the end 64 of the spool 14. The end 64 includes movable audio contacts 46(*a*) and 46(*b*). The hub 28 includes an electrical connector 22. The electrical connector 22 is hardwired to the contacts 50, which are inscribed within the hub 28. The contacts 50 are separated by circumferential ridges 48 to optimize alignment between the hub 28 and the school 14. The circumferential ridges 48 extend to the interior of the hub 28, which is hollow for receiving the end 64 of the school 14.

While the present invention is disclosed in terms of various embodiments, including preferred embodiments, it can be appreciated that the true scope of the invention is defined only by the appended claims.

We claim:

1. A cartridge for managing an ear bud cable, comprising:

a housing having an input jack that is electronically connectable to an audio-source;

a hub fixed in the housing, the hub has stationary audio contacts extending from the hub to create a stationary contact surface, the stationary audio contacts being electrically connected with the input jack;

a spool rotatably mounted on the hub, the spool having moveable audio contacts for continuously contacting the stationary contact surface during rotation of the spool;

an ear bud cable wrapped at least partially around the spool, the ear bud cable has a first end and a second end, the first end being electrically connected with the moveable audio contact of the spool and the second end being electrically connected with at least one ear bud; and rotation of the spool selectively retracts and dispenses the ear bud cables while enabling continuous communication between the at least one ear bud and the audio source, wherein the stationary contact surface includes at least one conductive contact circumscribing the hub.

2. A cartridge as set forth in claim 1, wherein the stationary contact surface includes several metallic contacts circumscribing the hub, the hub includes circumferential ridges which separate the several metallic contacts.

3. A cartridge as set forth in claim 2, wherein the housing has an output jack integrated with the input jack and the ear bud cables include a microphone for communicating voice via the cartridge.

4. A cartridge as set forth in claim 3, wherein the ear bud cable is flat, having a height and a width, wherein the width is more than twice the height.

5. A cartridge as set forth in claim 3, wherein the ear bud cable is flat, having a height and a width, wherein the width is more than twice the height, the ear bud cable includes two ear buds and a microphone.

6. A cartridge for managing an ear bud cable, comprising:

a housing having an input jack that is electronically connectable to an audio-source;

a hub fixed in the housing, the hub has stationary audio contacts extending from the hub to create a stationary contact surface and to electrically connect the stationary audio contacts with the input jack;

a spool rotatably mounted on the hub, the spool having moveable audio contacts for continuously contacting the stationary contact surface during rotation of the spool, the spool having an upper gear and a lower gear, and a cable track defined between the upper gear and the lower gear;

a power gear mounted in the housing and being connectable in operable engagement with both the upper gear and the lower gear of the spool; and an ear bud cable wrapped at least partially around the spool in the cable track, the ear bud cable has a first end and a second end, the first end being electrically connected with the moveable audio contact of the spool and the second end with at least one ear bud, whereby rotation of the spool selectively retracts and dispenses the ear bud cable while maintaining communication between the at least one ear bud and the audio source.

7. A cartridge as set forth in claim 6 further comprising a power spring mounted in the housing in contact with the power gear to rotate the power gear and the spool.

8. A cartridge as set forth in claim 6 further comprising a power spring mounted in the housing in contact with the power gear to rotate the power gear and the spool, the power spring having a spiral shape and designed to maintain a relatively consistent torque on the power gear.

9. A cartridge as set forth in claim 6 further comprising a rotary damper attached within the housing and connected in operable engagement with spool to regulate rotational velocity of the spool.

10. A cartridge as set forth in claim 6 further comprising a rotary damper attached within the housing, the rotary damper having gear teeth connected in operable engagement with the upper gear and the lower gear of the spool to regulate rotational velocity of the spool.

11. A cartridge as set forth in claim 6 further comprising a cable guide mounted on the housing, the cable guide receives the ear bud cable to guide the ear bud cable into and out from the cartridge.

12. A cartridge as set forth in claim 6, wherein the power gear, the upper gear and the lower gear have gear teeth that mesh.

13. A cartridge for managing an ear bud cable, comprising:

a housing having an input jack that is electrically connectable to an audio-source;

a hub fixed in the housing, the hub defines a stationary contact surface that circumscribes the hub and electrically connects with the input jack;

a spool rotatably mounted with respect to the hub, the spool having moveable audio contacts for continuously contacting the stationary contact surface during rotation of the spool; and an ear bud cable wrapped at least partially around the spool, the ear bud cable has a first end and a second end, the first end being electrically connected with the moveable audio contact of the spool and the second end being electrically connected with at least one ear bud, whereby rotation of the spool selectively retracts and dispenses the ear bud cables while enabling continuous communication between the at least one ear bud and the audio source.

14. A cartridge as set forth in claim 13, wherein the hub defines a hollow center for receiving a portion of the spool, the stationary contact surface includes at least one contact inscribed within the hub for continuously contacting the moveable audio contacts.

15. A cartridge as set forth in claim 13, wherein the hub defines a hollow center for receiving a portion of the spool, the stationary contact surface includes contacts having a ring shape and ridges having a ring shape for separating the contacts, the contacts and ridges being inscribed within the hub for continuously contacting the moveable audio contacts.

16. A cartridge as set forth in claim 13, wherein the stationary contact surface includes contacts circumscribing the hub, the hub includes circumferential ridges which separate the contacts.

* * * * *